United States Patent [19]

Williamson

[11] Patent Number: 4,678,366

[45] Date of Patent: Jul. 7, 1987

[54] BOAT LIFT

[76] Inventor: James W. Williamson, P.O. Box 93, Tahoe City, Calif. 95730

[21] Appl. No.: 761,204

[22] Filed: Jul. 31, 1985

[51] Int. Cl.[4] ..... B63C 3/06

[52] U.S. Cl. ..... 405/3; 405/1

[58] Field of Search ..... 405/1, 3, 104, 106, 405/196, 221, 231, 282

[56] References Cited

U.S. PATENT DOCUMENTS

| | | | |
|---|---|---|---|
| 2,647,772 | 8/1953 | Wernert | 384/152 |
| 3,276,211 | 10/1966 | Drake | 405/3 |
| 3,841,441 | 10/1974 | Klinkhammer | 405/3 X |
| 3,950,952 | 4/1976 | Krings | 405/282 |
| 4,482,268 | 11/1984 | Stevenson et al. | 405/3 |

OTHER PUBLICATIONS

Brochure from Marine Travelift Inc.

*Primary Examiner*—David H. Corbin

*Attorney, Agent, or Firm*—Townsend and Townsend

[57] ABSTRACT

A boat lift includes a vertical H-beam driven into the floor of a body of water adjacent a pier. A shaft housing surrounds the H-beam and slides up and down it on rollers mounted within the channels defined between the opposed flanges and web of the H-beam. A fork lift-like boat support is mounted to the shaft housing for vertical movement therewith to raise and lower a boat to and from the water. Forces are transferred from the shaft housing to the H-beam by the rollers engaging the web surfaces and the inner flange surfaces.A hoist, supported by the pier and the top of the H-beam, raises and lowers the shaft housing and boat support therewith.

29 Claims, 5 Drawing Figures

BOAT LIFT

BACKGROUND OF THE INVENTION

This invention concerns boat lifting devices, in particular one designed to lift a boat or other vessel along a single, rigid H-beam using a bi-support roller system having wheels contacting the web and inside flange surfaces of the H-beam.

It has long been appreciated that most boats will last longer if protected from the elements when not in use. To help protect the boats, boathouses have often built adjacent piers. The boathouse not only protects the boat from the rain and the seas, but they are often also outfitted with hoists to lift the boat out of the water when not in use. In addition to keeping the boat out of the water, boathouses also permit easy access to and from the boat. This is especially important in places where the water level rises seasonably, as in many fresh water lakes, or daily, as in tide influenced areas. Further, when the boat is on a hoist, it is often much more stable than when floating to further aid getting on and off the boat.

Although boathouses with overhead hoists have many advantages, in some areas, such as Lake Tahoe between California and Nevada, there are zoning restrictions which prohibit one from erecting a boathouse. One way to get around this restriction is by the use of a boat lift, which lifts the boat from below, rather than a hoist which lifts a boat from above.

Boat lifts must accommodate vertical forces from the weight of the boat, side-to-side, lateral twisting forces caused by waves and wind tending to move the boat, and vertical twisting forces caused by the boat not being exactly centered on the under-hull support members. Because of these forces, many of the prior art boat lifts use a number of submerged vertical posts and other support members to help reduce the problems associated with accommodating these large vertical and twisting forces. See U.S. Pat. No. 4,401,325 (Godberson).

Another type of boat lift, which looks like a fork lift with a single support driven into the bottom of the body of water, have been used at private piers at Lake Tahoe, Calif. for many years. An early version uses an H-beam as the main support with bearings mounted to the external surfaces of the H-beam flanges. This was found to cause binding if the boat was not exactly centered on the fork lift style tines. Therefore, later versions used a square tube as the main support. A number of rollers or other bearing members, mounted to a roller carrier, engage the outer surface of the square pipe. See U.S. Pat. No. 4,482,268 for an example of a more recent version of a single support type of boat lift using a square tube main support.

In many parts of the country, water levels change dramatically even in the course of 24 hours. This is especially true during ebb tide when the pier is much higher than the water level. Some of the prior art boat lifts have under-hull support projections below the frames. These projections can prevent the frame from being lowered as far as needed when the waters are extremely shallow. See, for example, U.S. Pat. No. 4,482,268 (Stephenson, et al.), U.S. Pat. No. 3,753,355 (Knoch), and U.S. Pat. No. 3,362,172 (Rutter). Also, with some prior art boat lifts, the boat cannot be lifted above the pier level, presenting problems during flow tides or other unusually high water levels. See, for example, U.S. Pat. No. 4,432,664 (Baldyga).

SUMMARY OF THE INVENTION

Applicant's invention is directed to a boat lift which is simple and economical in construction, provides a stable support for the boat and allows the support frame to move vertically between a position adjacent the floor of the body of water and a position substantially above the water level.

The present invention is directed to a boat lift including a vertical H-beam with a slidable housing mounted for movement along the H-beam. A vessel support frame is mounted to and extends from the housing. Wheel assemblies, including pairs of wheels, or other low friction elements, are mounted to the housing and engage the H-beam. The wheel assemblies fit in the region between the housing, the inner surfaces of the flanges and the web face. The wheels of each pair are typically perpendicular to one another with one wheel contacting the web face and the other contacting the inner flange surface. Preferably four pairs of wheels are mounted to the slidable housing so forces are evenly distributed along the H-beam to prevent any bending or twisting of the vessel lift structure.

The boat lift also includes a simple abovewater support mounted to and extending upwardly from the top of an existing wharf or pier.

To allow maximum elevation and descent, the applicant's invention, unlike the prior art, possesses no subframe projection so that the frame may be lowered completely to the bottom of the body of water.

Another key feature of the invention is the compactness of the slidable housing. This is achieved by the use of pairs of support wheels, or other lowfriction elements, mounted in the housing. Since the pairs of wheels are housed within the channels defined by the flanges and web of the H-beam, the housing can be made just slightly larger than the H-beam. Further, the wheels, when housed within a rectangular box-like slidable housing, are well protected against inadvertent damage.

Another aspect of the invention relates to the specific construction of the support bracket used with each wheel assembly. The bracket includes a base to which a pair of wheels are mounted, one with its axis generally parallel to the base and one with its axis generally perpendicular to the base. The bracket is constructed so that only one type is needed since the different orientations of the wheels needed to engage the H-beam at different positions are achieved by simply turning the bracket.

Other features and advantages of the invention will appear from the following description in which the preferred embodiment has been described in conjunction with the accompanying drawings.

DETAILED DESCRIPTION OF THE PREFERRED EMBODIMENT

Figure 1:
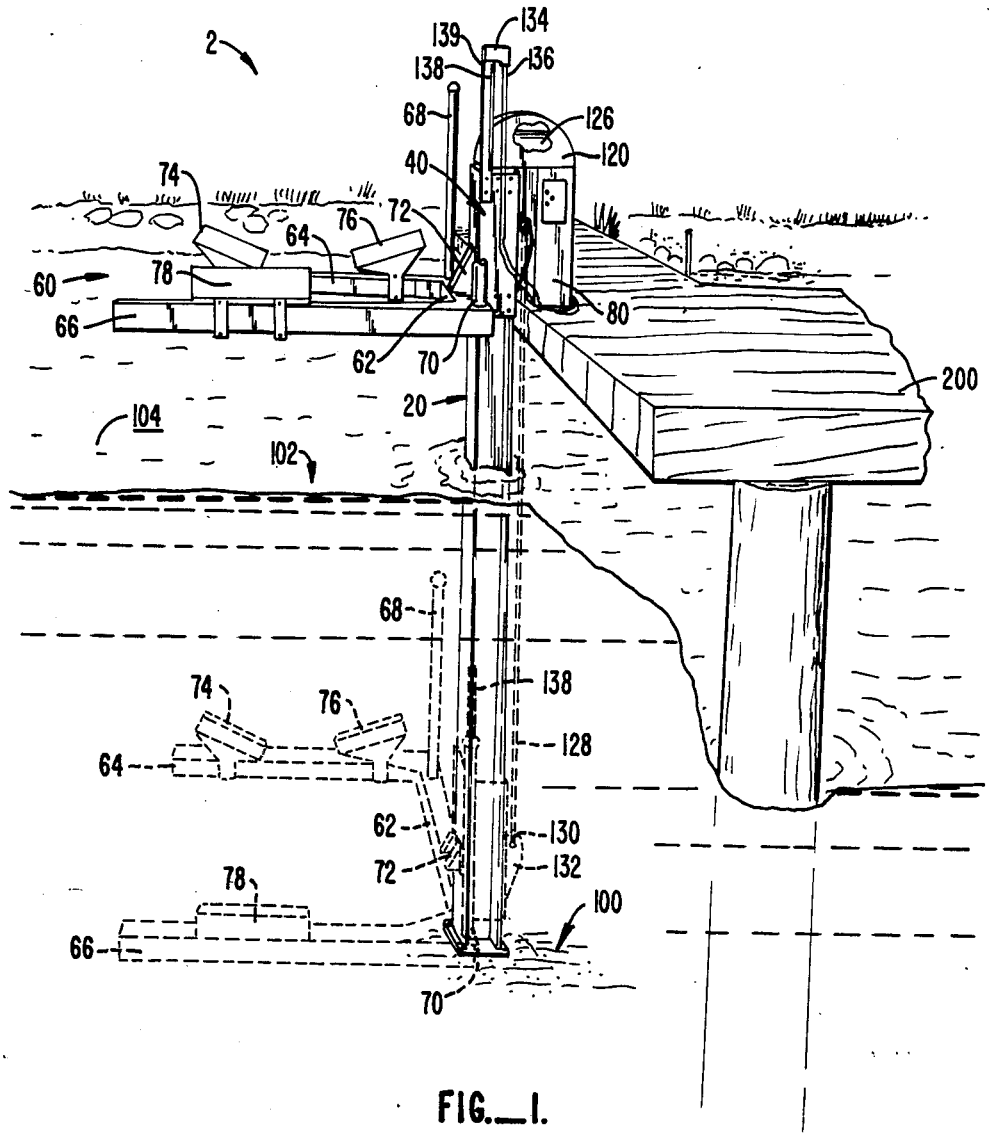
FIG. 1 is a perspective view of the boat lift as installed adjacent a pier.

A boat lift 2 as shown in FIG. 1 broadly comprises a vertical H-beam shaft 20 driven into the floor 100 of a body of water 102, a slidable shaft housing 40 fitted around H-beam 20 and a vessel support frame 60 extending laterally from housing 40. A motor housing 120 is mounted to the upper end of H-beam 20 at one end of housing 20 and to a support post 80, extending upwardly from a pier 200, at the other end of housing 120. Thus boat lift 2 is secured to both floor 100 and pier 200.

Figure 2:
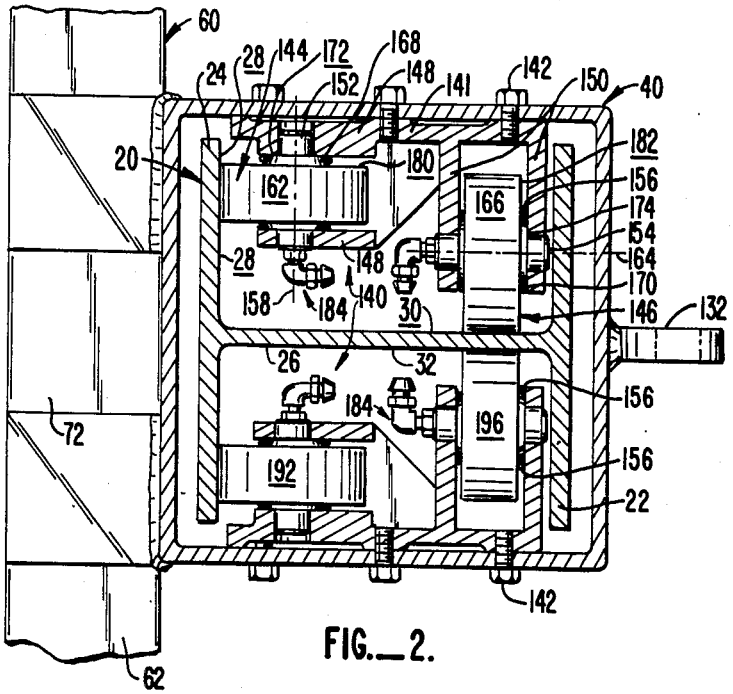
FIG. 2 is cross-sectional plan view showing the upper two wheel assemblies mounted on the slidable shaft housing and engaging the H-beam.
Figure 3:
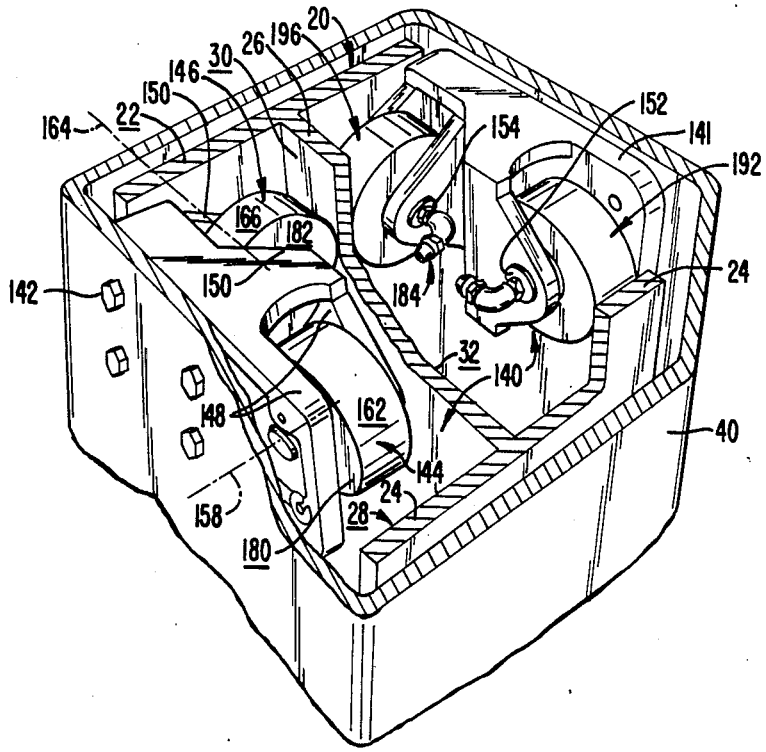
FIG. 3 is a cut away section of the shaft housing showing the upper two wheel assemblies engaging the H-beam rotated about 210° clockwise from the orientation in FIG. 2.

H-beam 20, as shown in FIGS. 2 and 3, comprises two flanges 22 and 24 and a central web 26. A wheel assembly 140, four of which are mounted to housing 40 by bolts 142, comprises a base 141, first and second wheel mounts 148, 150 and first and second perpendicularly disposed wheels 144 and 146 rotataby secured to wheel mounts 148, 150. The common axis 158 of first wheel 144 and first wheel mount 148 is perpendicular to web 26 so the periphery 162 of first wheel 144 contacts an inner surface 28 of flange 24. The common axis 164 of second wheel 146 and second wheel mount 150 is parallel to web 26 so its periphery 166 contacts a face 30 of web 26.

Wheels 144, 146 are rotatably mounted to first and second bearing shafts 152, 154 which extend between wheel mounts 148, 150. O-ring seals 156 (see FIG. 4) are positioned between wheel mounts 148, 150 and wheels 144, 146 around the shoulder 168, 170 of wheels 144, 146 to seal the gap between the wheel mounts 148 and 150 and wheels 144 and 146. Typically, wheels 144, 146 have a rounded periphery 162, 166 and flat sides 180, 182 with inclined shoulders 168, 170 defining plateaus 172, 174 which abut wheel mounts 148, 150.

Figure 4:
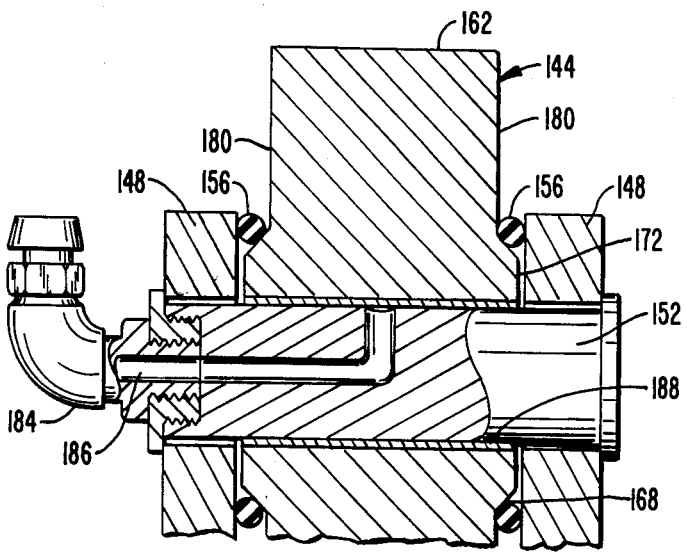
FIG. 4 is a cross-sectional view of a wheel taken along line 4—4 of FIG. 2.

Lubrication fittings 184 are provided for lubricating bearing shafts 152 and 154 through lubrication ports 186 (see FIG. 4). Wheel assembly 140 is positioned between first and second flanges 22 and 24 of H-beam 20. Shafts 152, 154 are journaled in bushings 188 mounted in wheels 144, 146. Preferably, four wheel assemblies 140 are mounted to slidable shaft housing 40 so forces are evenly distributed along H-beam 20.

O-ring seals 156 are slightly undersized relative to shoulders 168, 170 of wheels 144, 146 so they snugly fill the gap between the wheels and wheel mounts 148, 150. This is an effective yet simple way to keep sand, dirt and other matter away from bushings 188. This is especially important since lift 2 is often left resting on floor 100. Lubrication of wheels 144, 146 also helps to purge the bearing regions between the wheels and shaft 152, 154 and between the wheels and wheel mounts 148, 150.

Vessel support frame 60 comprises a horizontal cross-member 62 with horizontal front and rear tines 64 and 66 extending from cross-member 62. Cross-member 62 is welded to shaft housing 40 so that vessel support frame 60 is raised or lowered along with shaft housing 40. Vertical fender guides 68 and 70 are mounted onto support frame 60 and are preferably at the outer ends of cross-member 62. Guides 68, 70 help the operator properly position a boat and keep the boat from crashing into pier 200. A triangular wedge brace 72 is welded to cross-member 62 and shaft housing 40 to help strengthen frame 60. Vessel support frame 60 also contains rear and front cushioning blocks 74, 76 and 78 secured to tines 64 and 66. In the preferred embodiment, blocks 74, 76 and 78, consist of a single front 78 cushioning block and a pair 74, 76 of rear cushioning blocks.

Vessel support frame 60 is raised or lowered by a conventional hoist 126 located in motor housing 120. Hoist 126 is used to raise or lower a chain 128 with a hook 130 at its lower end secured to a wedgepiece 132 welded to shaft housing 40 on the side of housing 40 opposite frame 60. Hoist 126 is controlled by a controller 134 at the end of an electrical line 136. Controller is temporarily secured beneath motor housing 120 when lift 2 is resting on floor 100. A pipe 138 is mounted to and extends from shaft housing 40. When in use, and thus when upper end 139 of pipe 138 is out of the water, controller 134 is removably attached to upper end 139 so to be in easy reach of the user from inside a boat or on pier 200.

Figure 5:
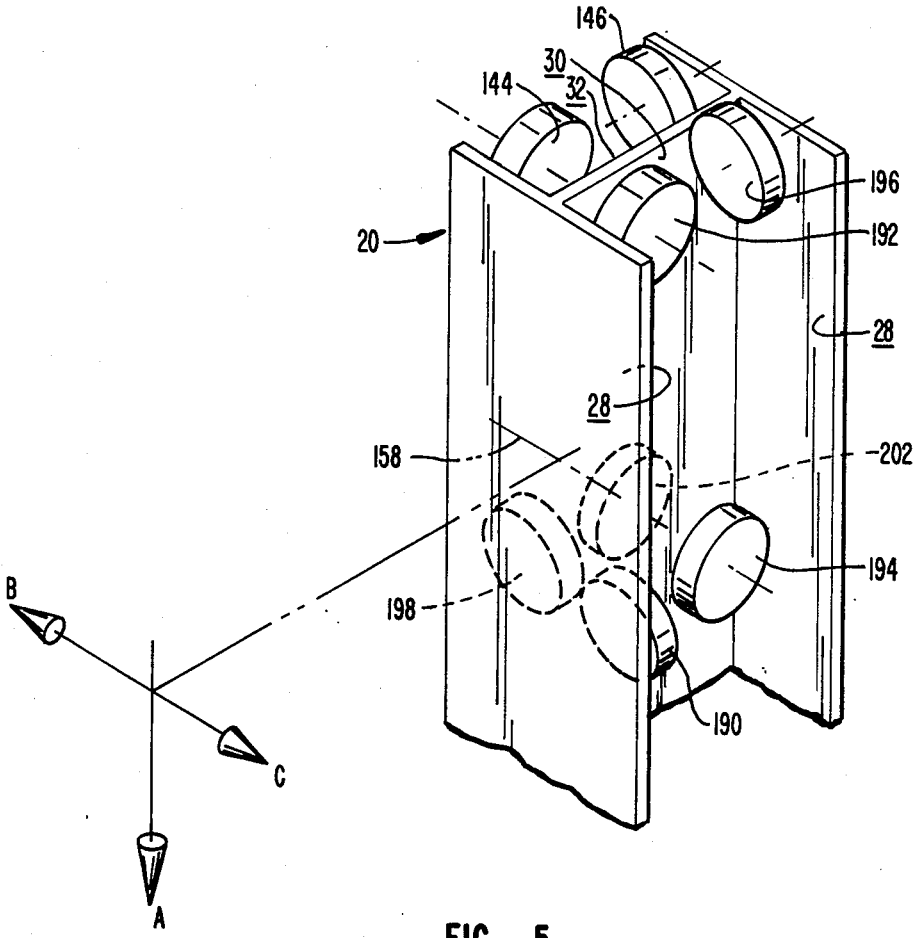
FIG. 5 is a schematic representation showing the engagement of the various wheels of the upper and lower wheel assemblies of the boat lift of FIG. 1 with the H-beam.

In this configuration, the forces exerted by a boat on frame 60 are transferred by shaft housing 40 to H-beam 20 through wheel assemblies 140 as shown in FIG. 5. A downward force A exerted by a boat on frame 60 produces a torque which compels wheels 192, 144, 194 and 202 towards the inner surfaces 28 of flanges 22, 24. A lateral force B on frame 60 produces both simple side forces on tending to push wheels 190, 196 toward a web face 30 and also produces torquing forces tending to force wheels 190, 146 against opposite web faces 30, 32 and wheels 192, 202 against flange surfaces 28. A lateral force C acts similarly to produce both simple side forces and lateral twisting forces. Hence, wheel assemblies 140 help uniformly distribute and mitigate the effect of the forces exerted by a boat 2 on frame 60.

In use, assuming support frame 60 is resting on floor 100, the user takes controller 134 from its normally stowed position under housing and between support post 80 and H-beam 20, and actuates hoist 126 to raise frame 60 to a suitable position just below the surface 104 of water 102. A boat is then positioned over blocks 74, 76, 78 and frame 60 is raised through controller 134. Controller 134 may be temporarily secured to upper end 139 of pipe 138 so when it is desired to re-float the boat, someone in the boat has access to the controller 134. Since upper end 139 of pipe 138 is well above water surface 104 when blocks 74, 76, 78 are just below the water surface, controller 134 is immediately accessible to persons in a boat when the boat is to be raised from the water as well as to persons on pier 200.

Modification and variation may be made to the disclosed embodiment without departing from the subject of the invention as defined in the following claims. For example, each roller may be individually mounted to shaft housing 40 rather than in pairs.

I claim:

1. A vessel lift comprising:

a vertical H-beam shaft having a central web and first and second flanges, the central web having first and second faces and the flanges having inner surfaces facing one another;

a slidable shaft housing fitted over said H-beam;

a vessel support frame mounted to said housing;

a vessel lifting mechanism operably coupled to the housing; and low friction means, mounted to the housing, for engaging the first and second faces of central web and the inner surfaces of the flanges of the H-beam to transfer loading forces exerted by the vessel on the support frame from the housing to the H-beam.

2. The vessel lift of claim 1, wherein said vessel support frame comprises:

a substantially horizontal cross member extending laterally from said housing; and tines extending transversely from said cross members.

3. The vessel lift of claim 1 wherein said lifting mechanism further comprises a motor housing at upper end of said shaft.

4. The vessel lift of claim 3 wherein the lifting mechanism includes a motor housed within said motor housing and drivingly connected to a lift line, the lift line attached to the slidable housing.

5. The vessel lift of claim 3 further comprising:

a support post substantially parallel to said H-beam shaft extending downwardly from said motor housing to a fixed support surface.

6. The vessel lift of claim 2 wherein said vessel support frame includes vertical fender guides.

7. The vessel lift of claim 6 wherein the horizontal cross member has outer ends and the vertical fender guides are mounted to said outer ends.

8. The vessel lift of claim 1 wherein said vessel support frame includes cushioning blocks for supporting vessel hulls thereon.

9. The vessel lift of claim 1 wherein said low friction means includes first and second perpendicularly disposed wheels carried by said slidable housing and positioned between the first and second H-beam flanges, the first wheel contacting a web face and a second wheel contacting an inner flange surface.

10. The vessel lift of claim 9 further comprising a wheel assembly including said first and second wheels.

11. The vessel lift of claim 10 wherein the wheel assembly includes a common base.

12. The vessel lift of claim 10 comprising first and second wheel assemblies, said first wheel assembly opposite said first H-beam face at a first level and said second wheel assembly opposite said second H-beam face at a second level.

13. The vessel lift of claim 12 wherein said first level is vertically above said second level.

14. The vessel lift of claim 12 including third and fourth of said pairs of wheel assemblies, said third wheel assembly opposite said second H-beam face at a third level and said fourth wheel assembly opposite said first H-beam face at a fourth level.

15. The vessel lift of claim 14 wherein the first and third levels are the same level and the second and fourth level are the same level.

16. The vessel lift of claim 14 wherein the second wheels of said first and third wheel assemblies contact said first flange and said second wheels of said second and fourth wheel assemblies contact said second flange.

17. The vessel lift of claim 10 wherein the wheel assembly includes first and second pairs of parallel wheel mounts between which the first and second wheels are rotatably mounted.

18. The vessel lift of claim 17 wherein the wheel assembly includes means for sealing the regions between the wheels and the parallel mounts.

19. The vessel lift of claim 17 wherein the first and second wheels and the first and second wheel mounts have opposed lateral sides, portions of the lateral sides defining circular, axially outwardly expanding sealing regions concentric with the wheel axes and wherein the wheel assembly includes a resilient sealing member sized to fit within the sealing regions and resiliently engage said lateral sides portions so to seal the regions between the lateral sides of the wheels and the wheel mounts.

20. The vessel lift of claim 10, where said wheel assembly includes means for lubricating said wheels.

21. The vessel lift of claim 10 wherein said wheel assembly comprises:

a wheel mount base including first and second pairs of perpendicularly disposed wheel mounts;

first and second bearing shafts extending between the wheel mounts of each of said first and second pairs of mounts, the first and second bearing shafts defining first and second axes, the first axis generally parallel to the web and the second axis generally perpendicular to the web;

wheels rotatably mounted to the bearing shafts between the wheel mounts of the pairs of wheel mounts; and O-ring seals positioned between the wheel mounts and the wheels to seal a gap between said wheel mounts and the wheels.

22. The vessel lift of claim 10 wherein the wheel assembly includes:

a base having outer and inner surfaces;

first and second parallel, spaced apart wheel mounts extending from the inner base surface and between which the first wheel is mounted for rotation about a first axis parallel to the base; and a third wheel mount mounted to the base and spaced apart from the inner base surface the second wheel being mounted for rotation about a second axis perpendicular to the inner base surface between said third wheel mount and inner base surface.

23. The vessel lift of claim 1 wherein said low friction means includes:

a first low friction element engaging the inner surface of the first flange at the first level;

a second low friction element engaging the second web face at a second level;

a third low friction element engaging the first web face at a third level; and a fourth low friction element engaging the inner surface of the second flange at a fourth level.

24. The vessel lift of claim 23, wherein the first and third levels are the same level.

25. The vessel lift of claim 24 wherein the said second and fourth levels are the same level.

26. The boat lift of claim 23 wherein the first, second, third and fourth low friction elements are wheels.

27. A vessel lift comprising:

a vertical H-beam shaft having a central web and first and second flanges, the central web having first and second faces and the flanges having inner surfaces facing one another;

a motor housing at an upper end of said shaft;

a slidable shaft housing fitted over said H-beam;

a vessel support frame mounted to said housing;

a vessel lifting mechanism including a motor housed within said motor housing and drivingly connected to a lift line, the lift line attached to the slidable housing;

a support post substantially parallel to said H-beam shaft extending downwardly from said motor housing to a fixed support surface;

low friction means, mounted to the housing, for engaging the first and second faces of central web and the inner surfaces of the flanges of the H-beam to transfer loading forces exerted by the vessel on the support frame from the housing to the H-beam, the low friction means including:

first, second, third and fourth wheel assemblies, mounted to said slidable housing, each wheel assembly including first and second perpendicularly disposed wheels positioned between the first and second H-beam flanges, the first wheel contacting a web face and a second wheel contacting an inner flange surface, said first wheel assembly opposite said first H-beam face at a first level and said second wheel assembly opposite said second H-beam face at a second level, said first level being vertically above said second level, said third wheel assembly opposite said second H-beam face at the first level and said fourth wheel assembly opposite said first H-beam face at the second level.

28. The vessel lift of claim 27 wherein the second wheels of said first and third wheel assemblies contact said first flange and said second wheels of said second and fourth wheel assemblies contact said second flange.

29. The vessel lift of claim 27 wherein said wheel assembly comprises:

a wheel mount base including first and second pairs of perpendicularly disposed wheel mounts;

first and second bearing shafts extending between the wheel mounts of each of said first and second pairs of mounts, the first and second bearing shafts defining first and second axes, the first axis generally parallel to the web and the second axis generally perpendicular to the web;

wheels rotatably mounted to the bearing shafts and between the wheel mounts of the pairs of wheel mounts; and O-ring seals positioned between the wheel mounts and the wheels to seal a gap between said wheel mounts and the wheels.

* * * * *